United States Patent [19]

Lefils

[11] Patent Number: 4,733,552

[45] Date of Patent: Mar. 29, 1988

[54] MULTI-STATION PUNCH/DIE PRESS FOR PROGRESSIVE STRIP STOCK OPERATIONS AT VARIABLE INDEX LENGTH

[76] Inventor: Michel E. Lefils, 2 rue George Huchon, 94300 Vincennes, France

[21] Appl. No.: 840,789

[22] Filed: Mar. 18, 1986

Related U.S. Application Data

[63] Continuation-in-part of Ser. No. 568,703, Jan. 6, 1984, abandoned.

[30] Foreign Application Priority Data

Jul. 21, 1982 [FR] France ..... 82 12701

[51] Int. Cl.[4] ..... B21D 43/00; B21D 37/04

[52] U.S. Cl. ..... 72/405; 72/404; 72/481; 72/472; 72/462; 83/561

[58] Field of Search ..... 72/481, 472, 477, 462, 72/405, 404, 442, 446, 448, 447, 478; 83/556, 553, 559, 561

[56] References Cited

U.S. PATENT DOCUMENTS

| | | | |
|---|---|---|---|
| 1,402,284 | 1/1922 | Daniels . | |
| 1,462,733 | 7/1923 | Becherer . | |
| 1,768,294 | 6/1930 | Reid . | |
| 2,232,071 | 2/1941 | Laystrom | 72/405 |
| 2,989,936 | 6/1961 | Farnsworth . | |
| 3,060,845 | 10/1962 | Kent . | |
| 3,983,739 | 10/1976 | Randolph, Sr. | 72/478 |
| 4,151,736 | 5/1979 | Quaas | 72/446 |
| 4,160,372 | 7/1979 | Bergman et al. | 72/462 |
| 4,327,618 | 5/1982 | Menard | 83/561 |
| 4,510,789 | 4/1985 | Tomioka et al. | 72/442 |

FOREIGN PATENT DOCUMENTS

| | | | |
|---|---|---|---|
| 271613 | 12/1964 | Australia | 72/404 |
| 2016458 | 10/1970 | Fed. Rep. of Germany | 72/481 |
| 2263836 | 10/1975 | France . | |
| 193243 | 11/1982 | Japan | 72/481 |
| 2064402 | 6/1981 | United Kingdom . | |
| 2063137 | 6/1981 | United Kingdom . | |

OTHER PUBLICATIONS

Baird, "Multiple Transfer Presses", 1968, p. 5.

*Primary Examiner*—Robert L. Spruill
*Assistant Examiner*—David B. Jones
*Attorney, Agent, or Firm*—Steele, Gould & Fried

[57] ABSTRACT

A press assembly is disclosed with a series of punch/die sets for successive operations on parts connected together in a strip. The punch/die sets are conveniently relocatable anywhere on regularly-spaced fixed stations and the stations can receive more than one punch/die set. The punches and dies in the sets can be mounted on removable base plates or otherwise made movable to any spacing, such that the sets are easily spaced to reflect a length of the parts being manufactured. The increment of strip feed between operations of the press is also adjustable. The press assembly can therefore be inexpensively set up to make parts of any characteristic length.

17 Claims, 24 Drawing Figures

MULTI-STATION PUNCH/DIE PRESS FOR PROGRESSIVE STRIP STOCK OPERATIONS AT VARIABLE INDEX LENGTH

CROSS REFERENCE TO RELATED APPLICATION

This application is a continuation-in-part of Ser. No. 568,703, filed Jan. 6, 1984, now abandoned.

BACKGROUND OF THE INVENTION

1. Field of the Invention

This invention relates to an assembly for implementing stamping, bending and like operations on a strip of sheet metal material, and in particular to such a device in which the operations are done on a sheet metal strip incrementally fed in successive steps of a length corresponding to a dimension of the manufactured part in the feed direction. The manufactured parts remain connected in the strip at least until the last operation. For convenience the operative tools are termed the "punch" or male part and "die" or female part, even though these parts may be reversible or their location or type may be irrelevant, for example in operations wherein neither part is strictly male or female. For convenience also, the part to which the male parts are secured and the part into which the female parts are cut are termed "punch holder" and "die holder" respectively, even though the dies can sometimes be their own holders.

The assembly of the invention has as many punch/die sets as required to conduct the operations, one or more punch/die sets being mounted as needed in fixed-position holders defining fixed work stations. The different punch/die sets are positioned relocatably on their respective holders, and are therefore movably spaced from one another, to correspond to the characteristic part dimension in the feed direction. The fixed-position holders are fixed to bed-plates of the apparatus firmly securable to the upper jaw and the lower jaw of a press.

2. Prior Art

In repetitively manufacturing parts from a strip of stock material, it has been known to design an assembly specific to the part in question, in which the spacing between fixed work stations corresponds to a dimension of the part to be manufactured. The strip stock is advanced stepwise between operations by a distance depending on the article being produced, whereupon the press is operated. The stepwise advance of the strip stock, referred to as the pitch, is different for articles of different size, for example an integral multiple of the length of a part along the strip. The parts are progressively formed to their final condition as they advance through the fixed stations. Frequently, large assemblies having a plurality of operations are particularly constructed, with punch/die sets spaced and rigidly fixed in accordance with the feed pitch of the particular article desired. Such assemblies are specific to the part they make. The assemblies are relatively costly and their construction is time consuming. They can only be justified if the run of parts to be manufactured is sufficiently large to cover the cost of the equipment carrying the tools. Consequently, medium scale mass production from strip stock (e.g., on the order of 6,000 parts per month) and small scale mass production from strip stock (e.g., 500 parts per month) are not economically feasible with such equipment.

In the case of such small and medium scale mass production techniques heretofore known, as many tools are used as there are operations to carry out, each tool having not only a particular punch, punch holder and die for the required operation, but also a specific fixed frame for mounting the device on a press and at least one pair of guide columns, appropriately positioned on opposite sides of the punch/die set, whereby the punch and die can be brought together when the part is in position.

In the event that manufacture by advance of connected parts in strip stock is to be abandoned in favor of synchronously-operated fixed-position punch/die sets, then use of the equipment requires additional time and labor in order to present the part successively to each of the successive sets of tools.

The present invention comprises punches and dies, the working punch or die being carried by or cut into a holder which is readily mounted or demounted. A clamp holds the base part of each punch or die holder at a fixed position on a bed-plate of the press. The punch or die is positionable as required on or in its holder to accommodate a feed pitch for a given part regardless of spacing between the rigidly fixed stations. In changing a press to accommodate a different part and a different feed pitch, the punch/die sets can be replaced in their respective holders with punch/die sets positioned on the stations and spaced from one another to reflect the new pitch. Furthermore, in the case of failure of a punch, repair requires—in addition to the tooling of a new punch—only the extraction of the punch holder from its associated bed plate and the replacement of the broken punch, which will generally require less than one minute, rather than a complete disassembling and reassembling of the structure as in the case of a conventional apparatus, requiring hours of work. Furthermore, when a part of given characteristics is no longer to be manufactured, only the punch or die holder and the punches and dies themselves are rendered unusable, rather than the loss of the whole punch/die structure and its mounting.

SUMMARY OF THE INVENTION

It is an object of the invention to reduce the price of punch/die tool sets adapted for progressive press operations and used for manufacture of parts from strip stock.

It is another object of the invention to make press and means for mounting its tool sets (punches and dies) dimensionally unrelated to the part being manufactured insofar as possible, but instead to make the sets adaptable to the construction of different parts, without increasing the cost of the tool sets by a full multiple.

It is another object of the invention to allow economy of mass production normally associated with large scale production runs, on a machine adapted for small and medium scale production runs from strip stock.

These and other objects are achieved by an assembly having a series of fixed work stations adapted to receive one or more tool sets at any position thereon, such that the spacing between the tool sets can be conveniently and inexpensively changed to reflect the feed pitch characteristic of a large number of different size parts to be manufactured. Depending on the part to be manufactured, the particular point of operation of the punch/die tool set within its work station may vary back and forth along the feed direction with respect to the center of the work station as defined by a holder for the punch/die sets. There may also be a plurality of punches or operators placed in each given work station, as required to accommodate the feed pitch for a characteristic dimension of parts to be manufactured. In this way, the investment in designing and mounting the tool sets is considerably reduced. Only limited elements of the tool sets (i.e., only the punch and die parts of the tool sets) need to be made specific to the part being manufactured. The remainder of the machine is adapted to fixed work stations for the punch/die sets, the punch/die sets being themselves locatable as required within the fixed work stations to reflect the desired feed pitch. In addition to lowering the cost of the tool sets by reducing the consumable portion thereof, manufacturing the parts by working strip stock in medium or small scale production runs according to the invention becomes economically feasible. At the same time, the cost and complication of die set replacement is considerably reduced, and the press is easily adaptable to job changes.

In a preferred embodiment of the invention, punch and die holders are fixed at cut-outs in the bed plate or other common frame. Clamps affix the punch/die holders to the bed plate. The punches/dies are relocatably mounted upon or cut into holders of standard dimensions, whereby the punches/dies are interchangeable in any of the work stations by moving their holders, and the punches/dies are conveniently repositioned within any station by use of a new holder. This allows variations beyond the possibility of positioning the punch/-die sets on fixed work stations, whereby the punch/die sets can easily define appropriate intervals for any feed pitch. It is further possible to change the order or character of individual operatins within the succession of operations, while maintaining other elements of the assembly unchanged, and without the need to remanufacture a whole new bed-plate and die set assembly.

The press assembly of the invention includes both invariable and variable elements, the invariable standardized elements comprising the bed-plates, the punch/die caps or supports and the frame, and the interchangeable elements comprising the punches and dies on their holders for fitting within the bed plates.

Attributes of the invention are also applicable to tools adapted for reworking parts manufactured elsewhere, for example, bending already-produced parts mounted so as to step incrementally at a given pitch. In such a case, the press assembly includes a bed-plate with standardized openings for mounting corresponding punches and dies. In this standard structure, the punches and dies can be individually changed and/or modified for a relatively small cost.

The invention allows a range of frames to be created supporting tools for producing work pieces of different widths.

In addition, by increasing the number of work stations, complicated work pieces may be produced requiring a large number of operations.

In the principle of the invention, a range of standard frames, independent of the shape of the work piece to be produced, may be produced and kept in stock.

The tools are also formed of standardized elements of simple shape. The blanks may also be kept in stock and machined on request for producing any work piece.

Thus the time required for designing and producing a new work piece can be reduced.

BRIEF DESCRIPTION OF THE DRAWINGS

There are shown in the drawings the embodiments that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1A:
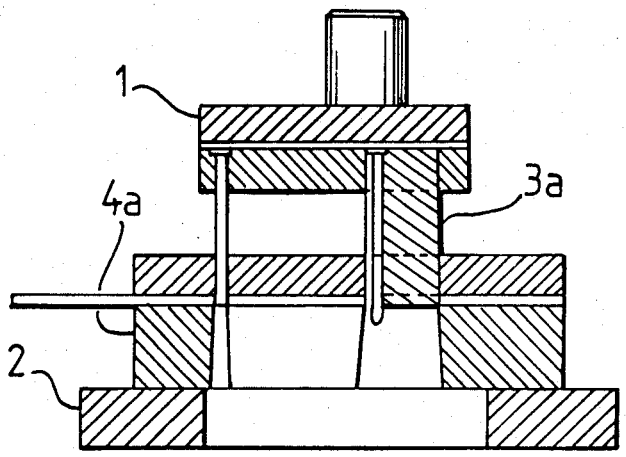
FIGS. 1*a* and 1*b* are section views of a blanking tool and a bending tool, illustrating, for example, the first step in a small or medium scale mass production, according to the prior art.
Figure 1B:
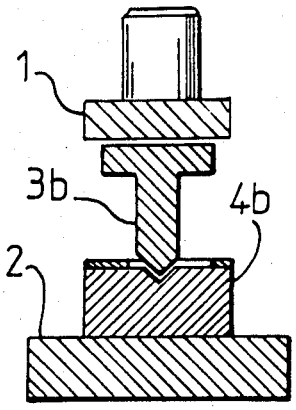
Figure 2A:
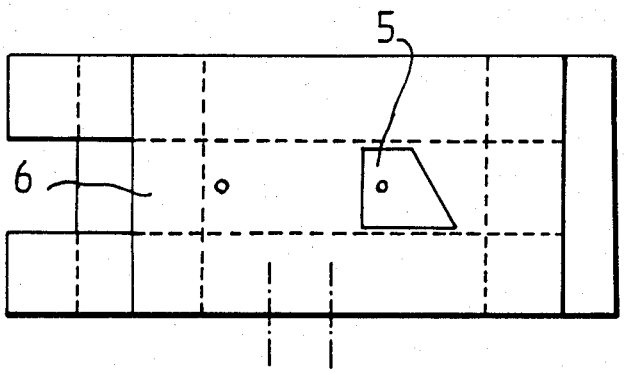
FIGS. 2*a* and 2*b* are top views of the blank, such as worked by the tools of FIGS. 1*a* and 1*b;*
Figure 2B:
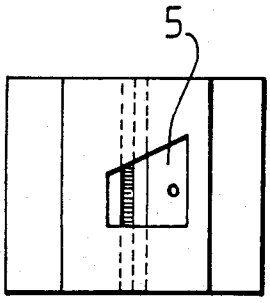
Figure 3A:
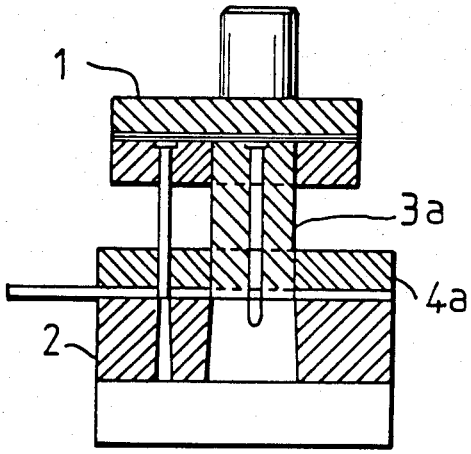
FIGS. 3*a* and 3*b* are sectional views of a blanking tool and a bending tool, for example as used in an alternative manufacturing step in small or medium scale mass production, according to the prior art.
Figure 3B:
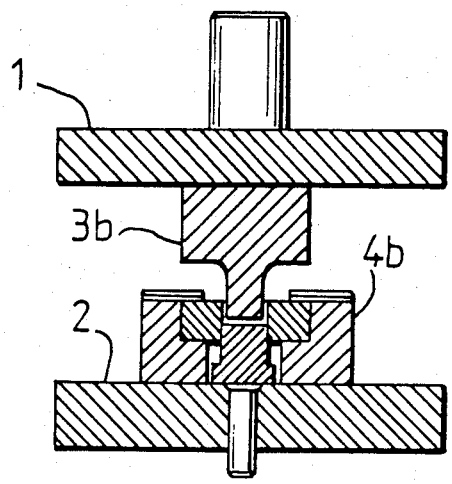
Figure 4A:
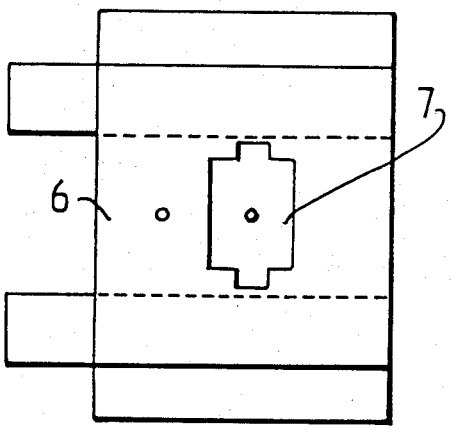
FIGS. 4*a* and 4*b* are top views of the blank, such as worked by the tools of 3*a* and 3*b;*
Figure 4B:
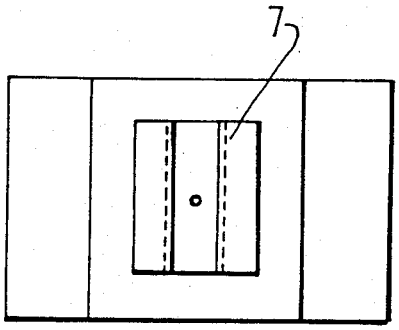

A bent trapezoidal part is shown being produced in FIGS. 1*a*, 1*b*, 2*a* and 2*b*, in accordance with the prior art. The particular formation of the part by means of punch/die set operation is performed at spaced work stations by means of cutting out the blank (FIGS. 1*a* and 2*a*) and bending it (FIGS. 1*b* and 2*b*). The actual cutting and bending operations are conventional steps in making parts. However, according to the invention, the tool sets are to be mounted so as to be optimally variable in their positions within fixed work stations, to match a variable feed pitch. In each case, as in the prior art, the tools comprise a punch cap 1 opposed against a corresponding frame part 2. Alignment between the punches 3*a*, 3*b*, and the dies 4*a*, 4*b*, is achieved in each case by aligned bearing-carried columns (not shown). Likewise, in FIGS. 3*a*, 3*b*, 4*a*, and 4*b*, a substantially rectangular part is formed by being extended along two extensions and bent. As in the previous example, a blank cutting-out tool (FIG. 3*a*) and a bending tool (FIG. 4*b*) are provided, being separate from one another and each having an individual punch cap 1, and frame part 2, supported on their respective bearing-carried columns (not shown).

Punch and die sets as described can be repetitively operated and spaced to treat material being incrementally advanced between operations while connected in a strip (i.e., "strip stock"). In so doing, it is necessary to mount the punch and die sets at a spacing reflecting an integral multiple of the feed pitch. Of course, a machine can be individually designed to a given feed pitch. According to the invention, however, the portion of the overall machine that needs to be changed to accommodate a change in feed pitch is minimized by making the particular position of the punch/die sets easily relocatable on rigidly-mounted work stations in the bed-plates. As shown in FIGS. 5 and 6, the device no longer is characterized by a succession of separately-carried isolated tools. Instead, according to the invention, a succession of work stations is provided with a spacing that need not correspond to the feed pitch. Means are provided to change the feed pitch to accommodate different-sized parts, and the location of the individual punch/die sets within the work stations is made easily changeable to reflect the feed pitch. Accordingly, the common structure (i.e., the bed-plates and work station mounting) is not specific to any given part to be manufactured, but may be used for any size parts, and any different feed pitch.

Figure 5A:
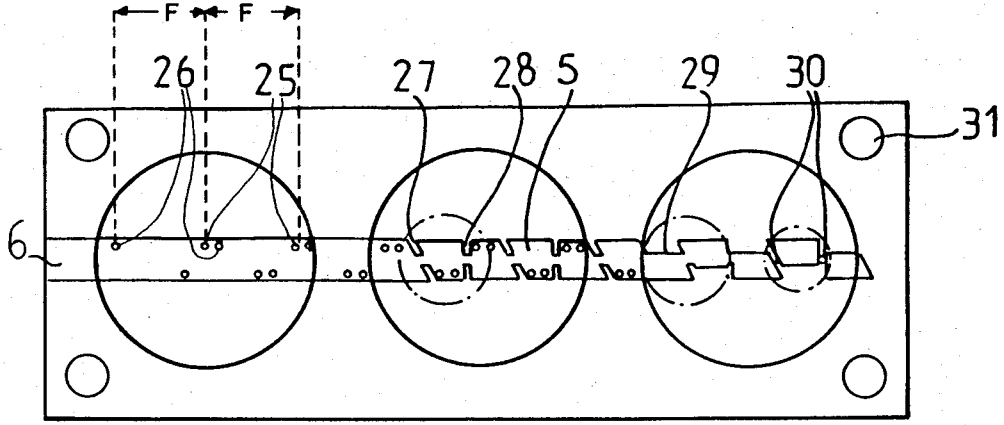
FIG. 5*a* is a plan view showing the progressive transformation of a blank manufactured in accordance with the invention.
Figure 5B:
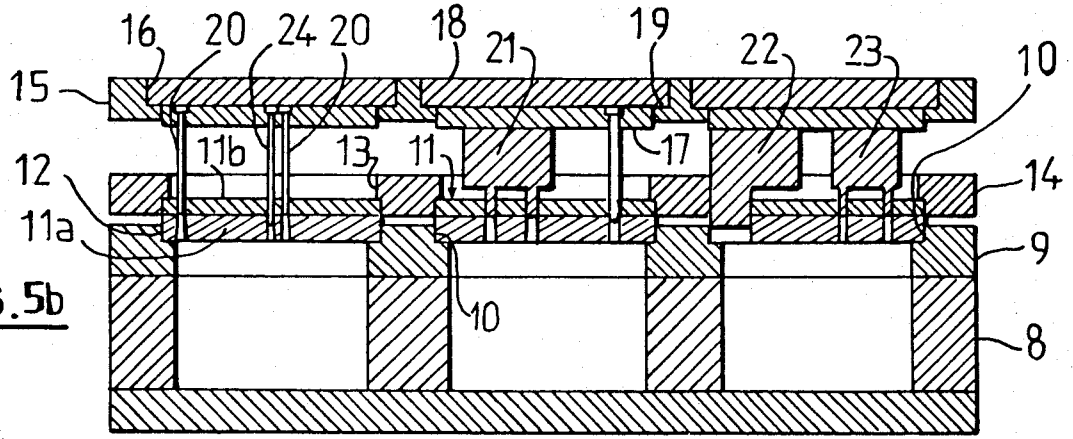
FIG. 5*b* is a section view through the assembly of the invention, adapted for carrying out the succession of operations shown in FIG. 5*a;*
Figures 6A, 6B:
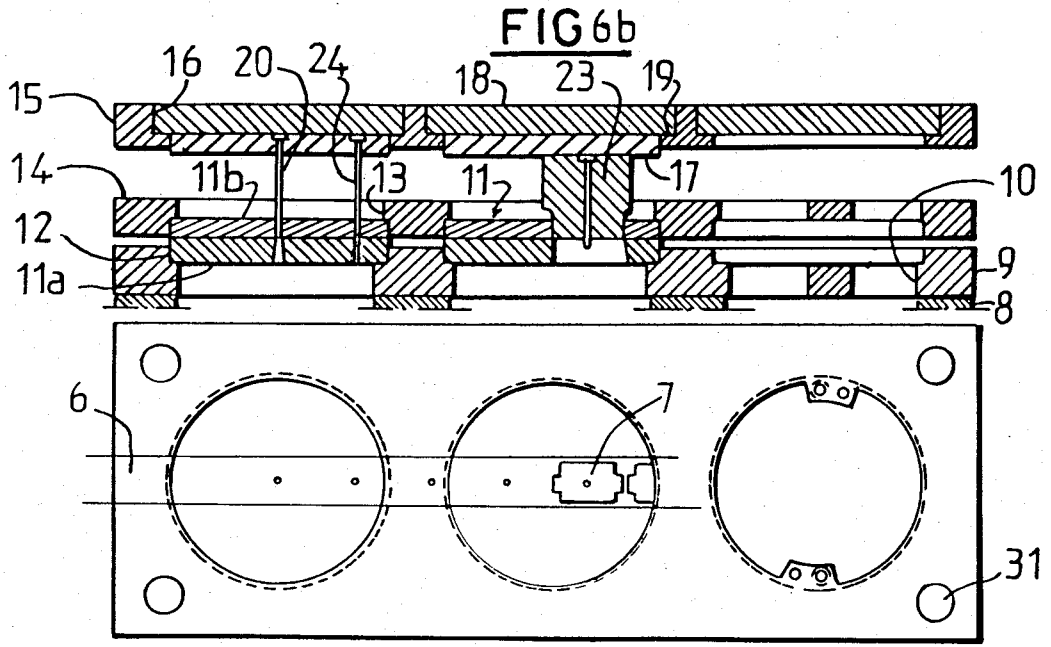
FIG. 6*a* is a plan view illustrating the stepwise transformation of a blank, manufactured in accordance with the invention.
FIG. 6*b* is a section view showing the assembly of the invention for carrying out the succession of operations shown in FIG. 6*a;*

The lower frame element or lower bed-plate 8, on which a die support 9 is mounted is shown in FIGS. 5*b* and 6*b*. The die support 9 has a plurality of cut-outs 10, for example circular, the cut-outs 10 being of standard diameter and constant spacing. The cut-outs 10 each receive a circular die 11*a* which bears on a shoulder 12 defined by the cut-out 10 in the die holder 9. A blank holder 11*b* is secured in a cut-out 13 provided in a blank presser 14 which is movable vertically downwards to immobilize the strip 6 of sheet material between said blank holders 11*b* and said dies 11*a*, and upwards to permit the advance of said strips between each step. The upper bed-plate 15 has a corresponding number of openings 16 the lower part of which has a diameter equal to similar openings in the die support 9, i.e., similar to cut-outs 10. The lower part of the upper openings are adapted for receiving punch holders 17, and positioning them directly opposite the dies 11 for engaging the blank holders and the dies when the press bed-plates are moved together. Each punch holder 17 is mounted on a punch cap 18, which is locked in the upper bed-plate 15 at the level of shoulder 19 provided in opening 16.

As seen in FIGS. 5*a* and 5*b*, frame 8, die support 9, blank presser 14, upper bed-plate 15, and punch caps 18 are invariable elements, being always the same in position and type. Punch holder 17, dies 11*a*, and blank holders 11*b* on the other hand, are easily removable and interchangeable. The dimensions of the interchangeable elements and the fixed elements are such that any of the interchangeable elements can be placed in any of the work stations desired, and there fixed. The particular operations, however, which would otherwise each require an individual punch cap and frame, are placed together on the fixed work stations at a spacing corresponding to the feed pitch. The left-most work station in FIG. 5*b* includes two punch elements 20, spaced to fit with the feed pitch F of the strip stock 6. The feed pitch is equal to a characteristic dimension of the part along the feed direction and need not be equal to the spacing of the fixed stations or even a multiple thereof. The central station in FIG. 5*b* has one punch/die set, i.e., that is required to accomplish a pre-bending operation. In the right most station, punch parts 22, 23 effect bending and separation, respectively, and like the other tool set parts are spaced to reflect an increment of the feed pitch rather than the spacing between the fixed work stations. In this respect, the work stations may include holding stations, i.e., wherein the tool sets are actually pilot pins 24 that hold the stock in position and keep steady the incremental feed of blank 6.

There are in fact a pair of punches of each above-mentioned type per work station so that each operation prepares two parts 5 positioned alternatively head-to-tail, the feed increment F being equal to twice the length of one part. This step is shown in FIG. 5*a*.

Only the manufacture of parts 5 will, however, be described whose large base is directed downwards in the Figure. For the first step of blank 6, punches 20 pierce holes 25 and at the next step holes 26. After a number of steps, blank 6 reaches the prebending station where punch 21 forms the cut outs 27 and 28. After again a number of steps, blank 6 reaches the bending and separation station where punch 22 bends part 5 along line 29, after which the separation punch 23 finishes cutting out the part at 30. The steps are carried on at the same time, all punches and dies repetitively brought together as a unit. Of any one time the strip stock between the first and last punch die set includes connected parts at every stage of manufacture.

The invention is applicable to feeding parts in any integral multiple of a characteristic length. In any event, the standardized interchangeable parts, and in particular the punch holder 17, die 11*a* and blank holder 11*b* are large enough to allow variation of the spacing of the individual punches 20, 21, 22, 23 of the successive punching areas within the work stations, such that this inner or part-related spacing can be adapted to various different feed pitches of the blank, independent of the spacing of fixed work stations defined by the standardized tool set holders.

According to the invention, it is not necessary to provide individual bearing-carried guide columns for the punch/die sets. Instead, only four guide columns 31 are required for the whole press, as shown in FIG. 5*a*.

The assembly shown in FIGS. 6*a* and 6*b* comprises similar basic structure in that parts 7 have a length that does not correspond to the spacing of die plates 11*a*, and the parts are produced by making the punch/die sets easily relocatable within the work stations defined by die supports 9, blank presser 14, punch caps 18, etc. In this case, part 7 is prepared by punching at the first station and cutting out at the second station, the third station being left vacant as unnecessary to this operation. By comparing FIGS. 5*b* and 6*b*, it is seen that in the second work station, punch 21 does not occupy the same position as punch 23. Instead, the particular position of the punches is variable within the confines of the work station defined by the die and punch holders locatable within the stations in upper bed plate 15 and die support 9, respectively.

Figure 7:
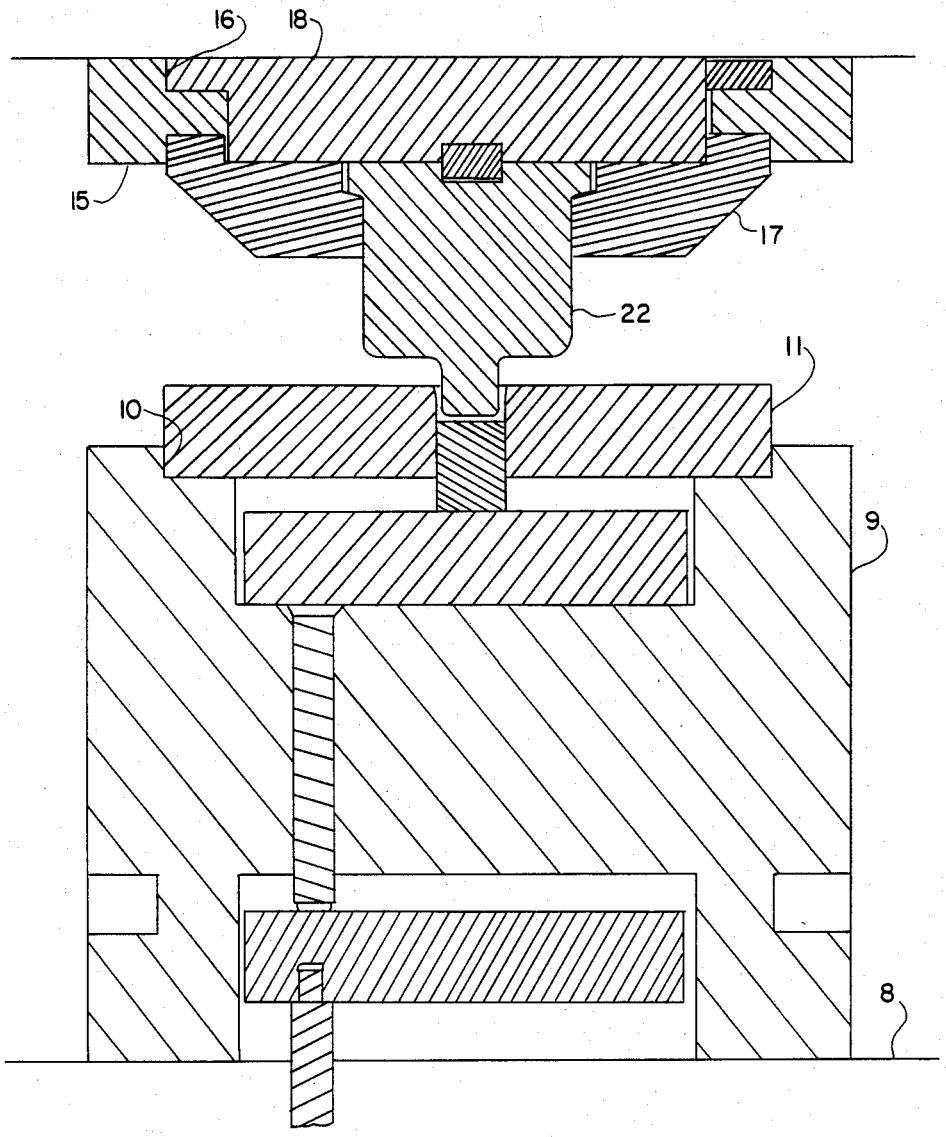
FIG. 7 is a section view of a standardized tool for a reworking operation.

FIG. 7 shows a reworking tool which may be used for bending part 7, as shown in FIG. 6*a*. The punch portion 22 in FIG. 7 is relocatable along its punch cap 18, and fixable for example by means of fixing plate 17, such that the spacing of the individual punch/die sets for cutting and bending operations can be located along the feed path to correspond with the feed pitch of various different parts to be manufactured.

Figure 9:
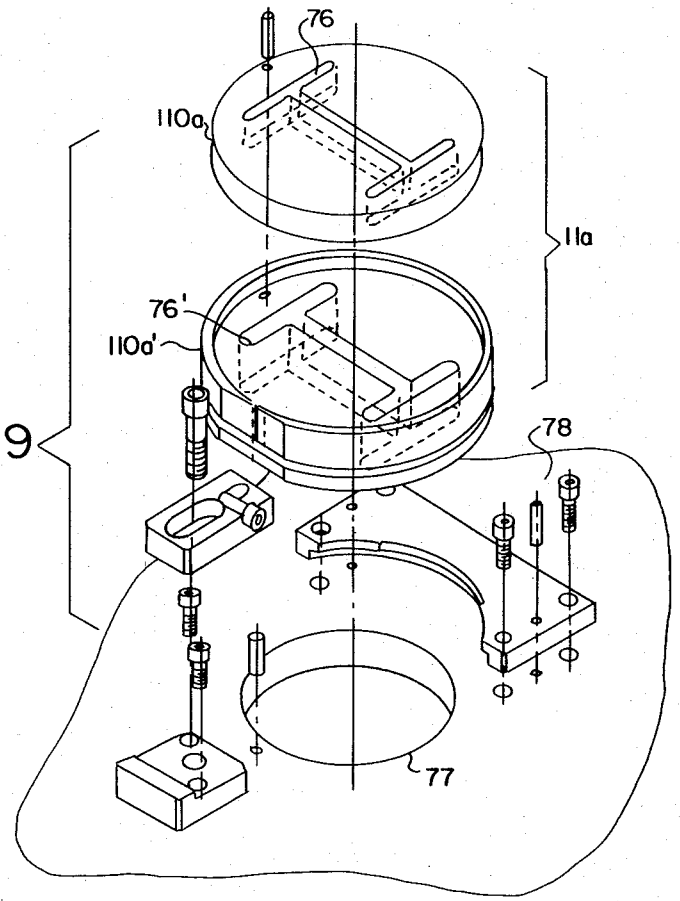
FIG. 9 is an exploded perspective view showing mounting a die to a bed-plate by means of a die holding and clamping fixture according to the invention.
Figure 8:
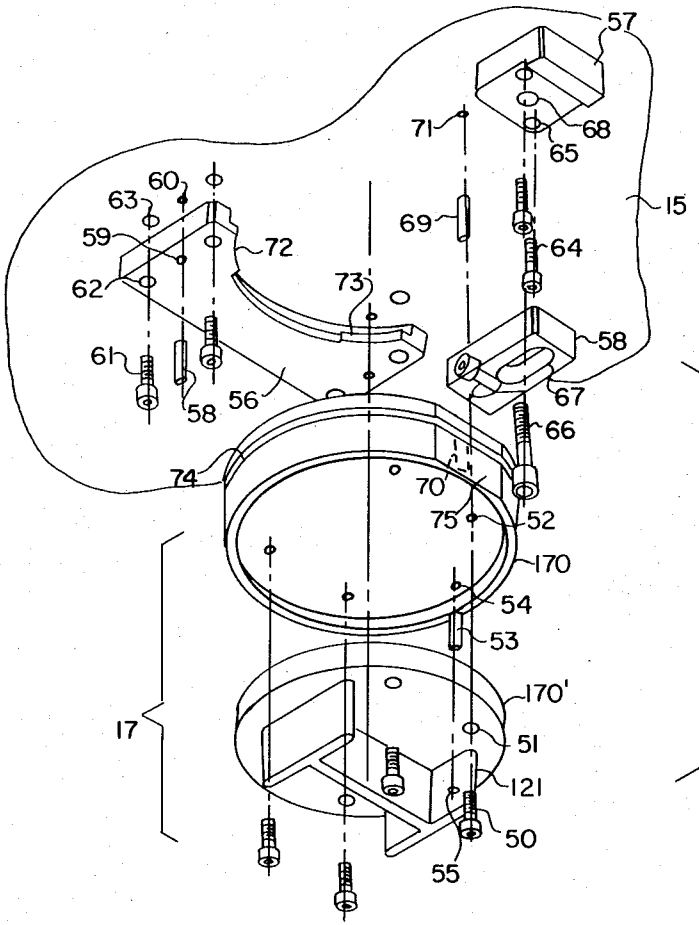
FIG. 8 is an exploded perspective view showing mounting of a punch to a bed-plate by means of a punch holder and clamping assembly according to the invention.

A preferred mounting arrangement for the punch/die sets is illustrated in FIGS. 8 and 9. In FIG. 8, punch holder 17 includes two parts, 170 and 170'. Punch 121, for example an H-shaped punch as shown, fits into a groove of the same shape, provided in holder part 170'. The punch 121 can be held to punch base plate 170' by means of screws (not shown) directed into punch 121 from the rear side of base 170', holding punch 121 in the groove. Holder part 170' and punch 121 together form a tool that is dimensioned to correspond to the part being manufactured. These parts may be permanently associated, and it is not intended to remount punch 121 on another base plate. Nevertheless, the assembly of punch 121 and holder 170' is easily replaced. Furthermore, a standardized punch device such as H-punch 121 can be positioned as required within the fixed work station by use of an appropriately-cut holder part 170'. Holder part 170' and its punch 121 are fastened in turn to punch holder part 170, using four screws 50, passing through holes 51 and threaded into bores 52. An indexing pin 53 preferably cooperates with corresponding holes 54, 55 provided for exactly positioning holder part 170' in holder part 170.

Holder part 170, and the punch parts carried thereby, are removably fixed to bed-plate 15 using a clamping arrangement. Fixed flange 56 and mounting plate 57 for a movable clamp 58 are directly affixed to the bed-plate 15. Fixed flange 56 is precisely positioned on the bed-plate by means of a locating pin 58 passing through corresponding-positioned holes 59, 60 in the fixed flange and the bed-plate, respectively. Four screws 61 are threaded into holes 63 in bed-plate 15, through holes 62 in the fixed flange 56. Similarly, mounting plate 57 is fastened by two screws 64 threaded into holes 65. Clamp 58 is attached to mounting plate 57 by means of a screw 66 passing through elongated hole 67, and threaded into hole 68. Accordingly, clamp 58 is allowed a certain range of movement toward and away from fixed flange 56.

Holder 17 is exactly positioned by means of a pin 69, passing through hole 70 in the punch holder and hole 71 in bed-plate 15. Two projections 72, 73 of flange 56, spaced above the level of bed-plate 15, penetrate into a groove 74 provided around the periphery of punch holder part 170. Holder 17 is firmly fastened in correct fixed position by adjusting clamp 58, which cooperates with a flat portion 75 of holder part 170. In this manner, all the parts except holder part 170' and its punch, are permanent fixed structures that are reusable for any new and different holder part 170', equipped with the same punch or any other type of punch or punches as needed for a new production run. The location of one or more punches with respect to the fixed station is defined by removably-attached holder part 170 and its connecting structure including fixed flange 56 and movable clamp 58. The tool set position(s) within the fixed station is carefully set depending on the dimensions of the article to be manufactured, and on the specific feed pitch adapted to the article. One or more punches can be placed at any location in the station, the punches for a plurality of such stations being relocatably positioned at any spacing from other punches on the same holder and on other holders.

A variable-step incremental drive for advancing the strip stock in increments is preferably provided. Incremental drives as known in the art may have mechanical or electrical means for accomplishing a stepwise linear motion. The distance of each step can be made variable electrically, for example using a shaft angle encoder and digital counter controlling a solenoid-powered clutch; or alternatively a mechanically-variable drive such as a continuously-variable transmission can be used with an intermittent drive transmission to adjust the step increment.

As shown in FIG. 9, the attachment of a corresponding die part to the opposed bed-plate 78 for cooperation with the punch part is preferably similar to the attachment of the punch part 121 and 170' to upper bed-plate 15. Die **11*a* comprises two parts, 110*a* and 110*a'*, similar to the two part punch holder 17, comprising parts 170 and 170'. Die 11*a* could be made as a single part, however, it is preferred to use two parts, only the facing part being made of the more-costly hard material characteristic of cutting and bending tools. A relatively thin operative tool part is normally adequate, unless the stock material is quite thick or a bend is quite deep. For thicker stock material, die 11*a*** can be made as an integral part.

Die parts **110*a* and 110*a'* are provided with openings 76, 76', respectively, of a shape corresponding to the shape of the punch 121. Opening 76 corresponds closely to the size of punch 121 in order to accomplish cutting out material of that shape. Opening 76', however, is somewhat larger, for allowing the cut-out slugs to be removed from the cutting area. Lower bed-plate 78 is provided with a large opening 77, which permits waste slugs of any shape to be removed. Die 11*a* is comprised of similar parts as punch 17, including a holder part and a die part, mounted by means of a fixed flange and a movably-positionable clamp member. Only die 11*a* is specific to the part being manufactured, and the other structures define a permanent station, which can receive any particular die. The die includes one or more openings, the openings being easily relocatable at any position or positions, and any orientation on the surface of die 11*a***.

Means are provided for advancing continuous strip stock through the press assembly in successive steps of a length characteristic of each part to be manufactured, successive portions of the continuous strip stock being progressively formed as successive parts. Inasmuch as the apparatus is operable in general for parts of any characteristic dimension, the means for advancing the strip stock can preferably be continuously adjustable, or incrementally adjustable, for setting up a mass production run. The receiving means for the punch and die sets are set at fixed positions, and are re-usable for any production run. The punches and dies and the holders in which they are mounted or cut are easily replaced such that there is no difficulty with relocating the punch and die sets as required to reflect the feed pitch defined by the characteristic dimension of successive parts along the feed direction. Accordingly, the punch and die sets are thereby made easily and inexpensively adjustable with respect to their positioning on the work station and spacing from one another, notwithstanding the fixed positions of the receiving means in the bed-plates and their frames.

The foregoing description relates to re-machining tool set holder parts to the required shape to hold the tool sets at the characteristic spacing. Other means for making the punch and die sets easily relocatable in their spacing and positioning on the fixed work stations are possible, and will now be apparent to persons skilled in the art. In the case of small punch and die elements, it is possible to include any number of such elements for each station, as shown in FIGS. 5*a*, 5*b* and 6*a*, 6*b*. It is also possible to arrange mounting means on the punch and die holding plates, 170, 110*a*', respectively, to receive punches or dies at any of a number of incrementally spaced locations, for example defining a matrix of receiving means laid out like a peg-board, whereby a job change to accommodate a new feed pitch and a new characteristic part dimension can be accomplished by simply re-mounting the punch/die sets at a new one of said incremental positions. Another possibility is to employ a continuously-adjustable tool-set mount, for example using set screws for changing tool set positions along the feed direction. In all these embodiments, the work stations are fixed but the tool sets are easily and inexpensively relocated within the fixed stations to match a feed pitch characteristic of parts to be processed as strip stock.

Figure 10:
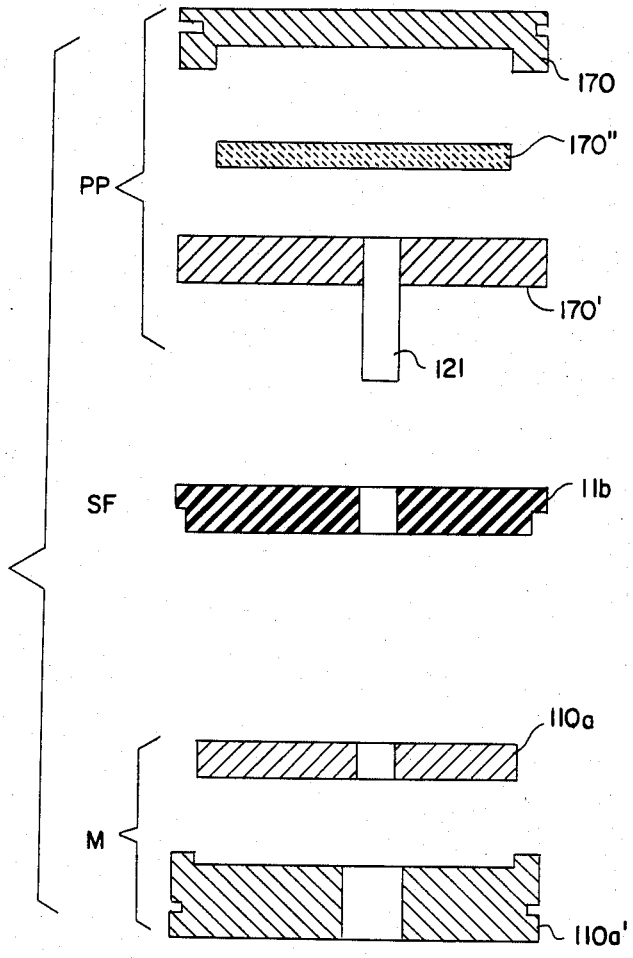
FIG. 10 shows, in schematical exploded section, the construction of a tool at a given work station.

If we now refer to FIG. 10, a schematical representation is given of the constituent elements of a work station, namely:

- a punch holder assembly PP formed by a collar 170, a punch holding and striking block 170'' and a punch guide disk 170' carrying a punch 121,
- a blank holder SF11b,
- a die assembly M formed of a die properly speaking 110*a* and a die holding collar 110*a*'.

Figure 11:
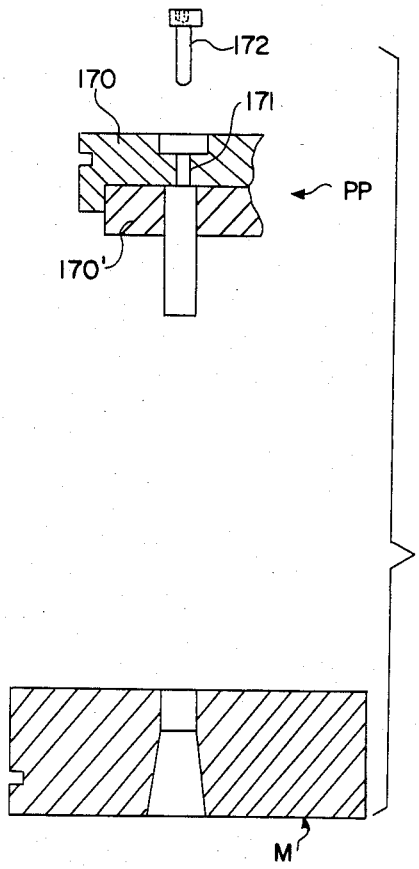
FIG. 11 shows, in section another possible construction of the punch holder assembly and the die assembly.

In the version shown in FIG. 11, the punch holding assembly and the die assembly are formed otherwise than in FIG. 10.

Thus, in FIG. 11, where the blank holder has been omitted, the punch holding assembly is formed of a collar 170 directly receiving the punch holding disk 170', in a recess provided for this purpose, without interpositioning of the striking block. The collar 170 has bore 171 adapted for receiving a screw 172 which penetrates as far as punch 121.

Furthermore, instead of a two part die assembly, in FIG. 11 a monobloc die M has been used.

Figure 12:
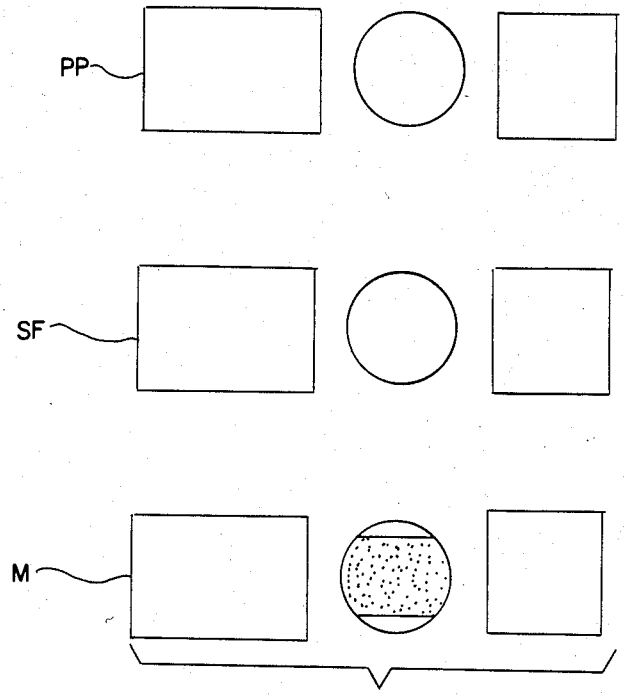
FIG. 12 shows some examples of possible forms for the working elements (punch holder, blank holder, die).

FIG. 12, shows, by way of example, three forms which may be used for the working elements (punch holder(s) PP, blank holder SF, die M), namely square elements, round elements and rectangular elements.

The preferred form of the invention is the circular form which has the advantage of being of a low production cost and of offering a considerable working zone, shown in grey in one of the Figures. The zones of this same Figure which are not grey correspond to the zones for fixing and positioning the elements.

Figure 13:
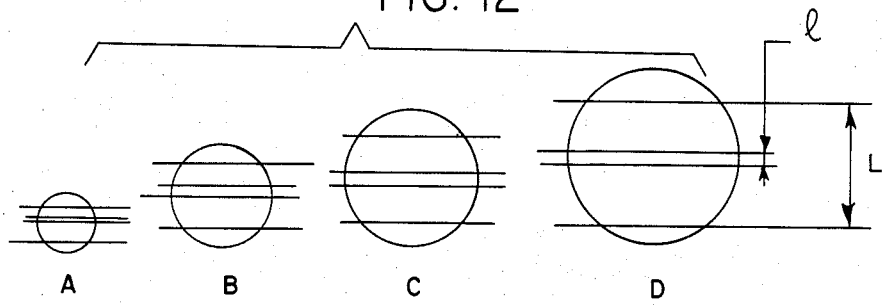
FIG. 13 shows the possibility offered by the method of the invention for fixing different working zone dimensions.

Referring to FIG. 13, a range of four dimensions of circular working elements A, B, C and D can be seen. With such a range, a whole range of widths of metal strips can be covered, the minimum width being shown by the letter l and the maximum width by the letter L for each dimension of the working elements.

Figure 14A:
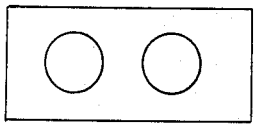
FIGS. 14*a* to 14*e* are general diagrams showing the construction of frames with two, three, four . . . n work stations corresponding to a given working zone dimension.
Figure 14B:
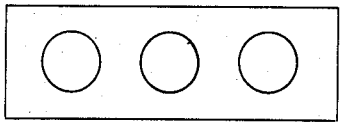
Figure 14C:
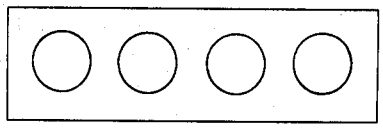
Figure 14D:
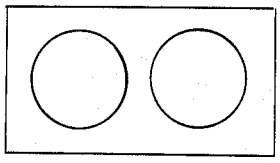
Figure 14E:
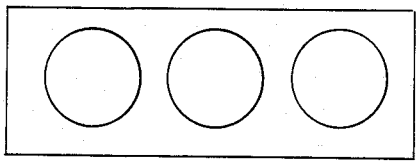

FIGS. 14*a* to 14*b* show respectively a frame having two work stations of dimension A (in FIG. 13), a frame with three work stations of dimension A, a frame with four stations of dimension A, a frame with two stations of dimension B (in FIG. 13) and a frame with three stations of dimension B.

Thus a family of frames corresponds to each working zone size. The user defines the frame adapted to his needs depending on the dimensions and complexity of the work pieces to be obtained.

Additional embodiments of the invention are likewise possible. Reference should be made to the appended claims rather than the foregoing specification as indicating the true scope of the invention.

What is claimed is:

1. A press assembly for manufacturing a plurality of different parts, comprising:

means for guiding a continuous strip of stock through the press assembly and means for stepwise advancing the continuous strip of stock in successive steps of an indexing length, said means for advancing being settable for selecting said indexing length from a plurality of indexing lengths, successive portions of the continuous strip stock to be formed as successive parts, the parts remaining connected in the strip;

upper and lower jaws mounted for relative movement toward and away from one another;

a bed-plate firmly secured to the upper jaw, the bed-plate having means for receiving at least two of any of a plurality of interchangeable punch holders for punches; and, a frame firmly secured to the lower jaw, the frame having means for receiving at least two of any of a plurality of interchangeable die holders for dies in alignment with the punch holders, the respective receiving means of the bed-plate and the frame defining at least two fixed work stations at a fixed spacing unrelated to said indexing length, the respective receiving means being so dimensioned that corresponding sets of punches and dies are mountable at a spacing equal to a multiple of said indexing length at any position within each fixed work station as required to place said sets at said spacing equal to said multiple of said indexing length, in respective punch holders and die holders, the sets being easily relocatable in positioning on each said work station to equal said multiple of said indexing length notwithstanding the fixed spacing of the work stations, whereby the press assembly can manufacture parts of any characteristic length by choosing the indexing length, spacing said sets at said multiple and stepwise advancing the continuous strip stock past the successive work stations between relative movement of the upper and lower jaws.

2. A press assembly according to claim 1 wherein the sets are relocatable by replacement of punches and dies carried in holders, the holders being mountable at fixed position within the work stations and the sets being relocatable in the holders.

3. The press assembly of claim 1, wherein at least one of the punch holders and die holders is affixed to the bed-plate by means of a fixed flange attached to the bed-plate and encompassing a part of the holders, and an opposed clamp, affixed to the bed-plate, the clamp urging said at least one of the holders under the fixed flange.

4. The press assembly of claim 1, further comprising a blank presser mounted to the press assembly and movable between the upper and lower jaws, the blank presser being movable against the stock for holding the stock in place and the blank presser having openings corresponding to the fixed work stations for passage of the punches.

5. The press assembly of claim 1, wherein at least one of the punch and die sets is a blank holding set having a pilot pin adapted to be inserted through a hole formed in the strip stock into a complementary opening therefor the pilot pin being positioned at an integral multiple of the characteristic length from an upstream punch die set which formed said hole in the strip stock.

6. The press assembly of claim 1, wherein the punches and dies are exactly positioned on their respective holders by means of locating pins.

7. The press assembly of claim 1, wherein the fixed flange is exactly positioned with respect to the bed-plate by means of a locating pin.

8. The press assembly of claim 2, wherein the punch and die sets have relatively more durable punch and die elements affixed to the holders, the holders being relatively less durable.

9. A press assembly for manufacturing parts in at least two successive operations from continuous strip stock fed to the press assembly in successive steps along a path, each successive step of the continuous strip stock defining an indexing length along a feed direction, successive portions of the continuous strip stock defining successive parts having a dimension along the path corresponding to the indexing length, the press assembly comprising:

means for guiding the continuous strip stock along the path and means for stepwise advancing the continuous strip stock by the indexing length, said means for stepwise advancing being operable at least at two different indexing lengths;

upper and lower jaws mounted for relative movement toward and away from one another and means for moving the jaws together between advances of the continuous strip stock;

an upper bed-plate firmly secured to the upper jaw, and a lower bed-plate frame firmly secured to the lower jaw, the upper and lower bed-plates having fixed means defining work stations immovably placed at a spacing independent of said indexing length, the work stations having receiving means for receiving punches and dies in opposed sets on the upper and lower jaws, the sets being spaced at a multiple of the indexing length other than said spacing of the work stations and successive sets along the path successively operating on each successive portion of the continuous strip stock between said advances, each successive portion of the strip stock being progressively formed into a successive part, the respective receiving means being so dimensioned that corresponding sets of punches and dies can be conveniently mounted at least at two selectable different positions within each work station, in respective punch holders and die holders, notwithstanding the fixed positions of the receiving means in the bed-plate, whereby the press assembly can manufacture parts of different characteristic lengths including lengths unrelated to the spacing of the work stations as the continuous strip stock is moved past the sets of punches and dies in feed increments corresponding to the characteristic length of the parts being manufactured.

10. The press assembly of claim 9, further comprising a blank presser movably mounted on the press assembly between the upper and lower jaws during operations of the press, the blank presser holding the continuous strip stock relative to the upper and lower jaws and permitting advance of the continuous strip stock between operations of the press, and the blank presser having openings for passage of the punches.

11. A press assembly of claim 9 wherein the sets are relocatable by replacement of punches and dies in respective punch and die holders, the holders being removably fixable on the bed plates.

12. The press assembly of claim 9, wherein at least one of the punch holders and die holders is affixed to at least one or the bed-plates by means of a fixed flange attached to said bed-plate and encompassing a part of the holders, and an opposed clamp, affixed to said bed-plate, the clamp urging said at least one of the holders under the fixed flange.

13. The press assembly of claim 9, wherein at least one of the corresponding sets of punches and dies have a pilot pin and receptacle for said pilot pin, the pilot pin and receptacle being positioned an integral multiple of the characteristic length downstream in the feed direction from a punch and die set operative to make a hole in the stock through which the pilot pin passes.

14. The press assembly of claim 9, wherein the punches and dies are exactly positioned on their respective holders by means of locating pins.

15. The press assembly of claim 9, wherein the fixed flange is exactly positioned with respect to the bed-plate by means of a locating pin.

16. The press assembly of claim 7, wherein the punch and die sets have more durable punch and die elements affixed to less durable holding means.

17. A method for producing an indefinite number of identical successive parts in a continuous strip progressing along a path, the parts having a characteristic length along the path, comprising the steps of:

providing a press having upper and lower jaws with receiving means disposed immovably at fixed locations along the path, the receiving means defining regularly spaced fixed stations, each of the stations having means for receiving tool holders along the path such that bringing together the jaws brings together the tool holders;

choosing the characteristic length of the parts independently of a distance between the regularly spaced fixed stations;

mounting punch and die sets on the tool holders at the characteristic length of the parts, the punch and die sets defining successive operations proceeding toward a finished part, whereby the tools sets are placed irregularly on individual ones of the tool holders but regularly at said characteristic length along the path; and, repeatedly advancing the strip along the path in an increment equal to the characteristic length and then reciprocating the jaws, whereby parts of any characteristic length can be produced regardless of the fixed regular spacing of the receiving means.

* * * * *